US005273721A

United States Patent [19]

Hallstrom

[11] Patent Number: 5,273,721

[45] Date of Patent: Dec. 28, 1993

[54] ENHANCED REAGENT UTILIZATION FOR DRY OR SEMI-DRY SCRUBBER

[75] Inventor: Rae A. U. Hallstrom, Mogadore, Ohio

[73] Assignee: The Babcock & Wilcox Company, New Orleans, La.

[21] Appl. No.: 910,062

[22] Filed: Jul. 8, 1992

[51] Int. Cl.[5] ..... F27B 15/08

[52] U.S. Cl. ..... 422/147; 55/459.1; 422/145; 422/168; 422/177; 95/219

[58] Field of Search ..... 422/168, 169, 170, 173, 422/177, 140, 145, 147; 423/243.05, 423.07, 243.08; 55/73, 459.1

[56] References Cited

U.S. PATENT DOCUMENTS

| | | | |
|---|---|---|---|
| 4,226,831 | 10/1980 | Dilworth | 422/173 |
| 4,305,909 | 12/1981 | Willett et al. | 422/169 |
| 4,446,109 | 5/1984 | Bakke | 422/168 |
| 4,511,434 | 4/1985 | Vasalos | 202/99 |
| 4,600,568 | 7/1986 | Yoon et al. | 423/244.08 |
| 4,614,167 | 9/1986 | Bergkvist | 122/4 D |
| 4,817,540 | 4/1989 | Razbin et al. | 110/266 |
| 4,885,139 | 12/1989 | Sparks et al. | 422/169 |
| 4,938,171 | 7/1990 | Detzel et al. | 422/145 X |

*Primary Examiner*—Robert J. Warden
*Assistant Examiner*—Krisanne M. Thronton
*Attorney, Agent, or Firm*—Robert J. Edwards; Michael L. Hoelter

[57] ABSTRACT

A flue gas scrubber for removing sulfur from flue gas. This scrubber, whether a horizontal or a vertical scrubber and whether a dry or a semi-dry scrubber, incorporates a recycle line that separates heavier dry solid particles from the finer particles still entrained within the cleaned flue gas. This recycle conduit then delivers these removed dry solid particles back to the scrubber for re-injection therein so as to reduce the drying time of the reagent slurry sprayed within the scrubber. Such drying time is reduced by the recycle of these dry solids because of the increased surface area overwhich the reagent is now sprayed.

6 Claims, 1 Drawing Sheet

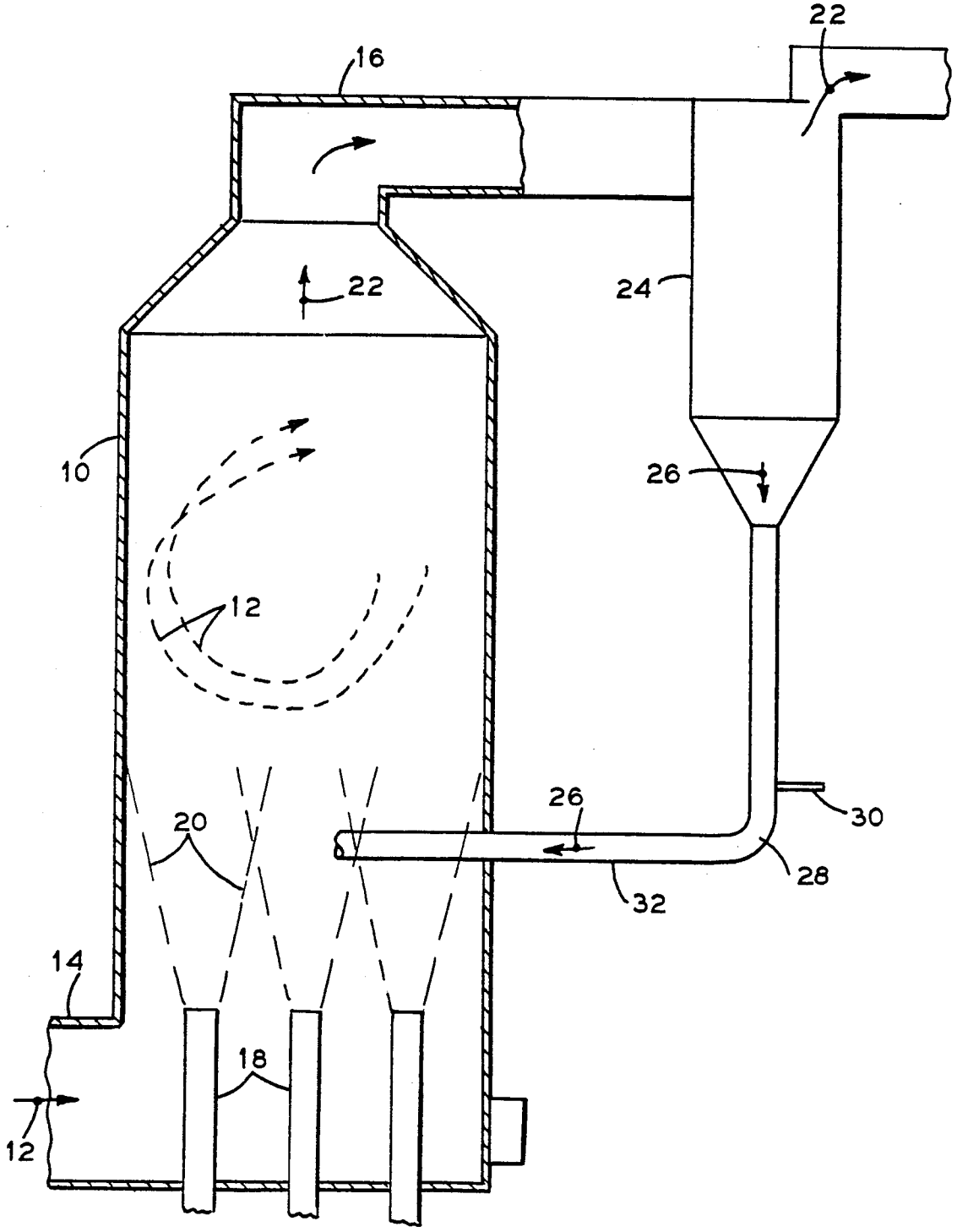
22
16
22
24
10
26
12
26
30
20
28
32
14
18
12

ENHANCED REAGENT UTILIZATION FOR DRY OR SEMI-DRY SCRUBBER

FIELD OF THE INVENTION

This invention pertains to the removal of $SO_2$ and solid particulates from flue gas by means of dry or semi-dry scrubbing and more particularly to enhancing such removal by recirculating dry fly ash back to the scrubber.

BACKGROUND OF THE INVENTION

Dry scrubbing is a process whereby flue gas is generally injected with a mixture of water, lime, and fly ash in order to reduce the $SO_2$ content in the flue gas. Other possible reagents (in addition to lime) include limestone, trona (sodium based), and magnesium compounds such as $MgCO_3$ and MgO. As this process proceeds, $CaSO_3 \cdot {}^{01}/_2H_2O$ and other waste product material (now in dry form) collect, agglomerate, and precipitate out while still being entrained within the flue gas. In some cases, a portion of this dry waste product material is captured, re-mixed with a lime slurry solution, and sprayed back into the scrubber for increased $SO_2$ removal. There are many designs for such a spray nozzle or atomizer so that the waste product/lime slurry solution is properly mixed and delivered as needed.

As is well known, the key to dry sulfur removal is intimate gas/slurry contact. To achieve optimum contact, control over the preparation and mixing of the waste product/lime slurry solution must be maintained. Subsequent to such contact, however, this slurry solution must be stored afterwhich it must be transported, such as by pumps, through the atomizers into the scrubber. Because of the removal of the waste product from the hot flue gas and its subsequent mixing with the lime slurry, the temperature of the captured waste product decreases dramatically. This encourages agglomeration to occur within the transportation system which can, and most likely will, plug the atomizers. To overcome this, a variety of spray nozzles have been designed with the stated purpose of correcting this deficiency. However, even the best laid plans often go awry because these designs address the symptom of the problem (preventing clogging) rather than the root cause of it (why is there agglomeration in the first place).

It is thus an object of this invention to provide a means of recirculating unreacted reagent back to the scrubber which will not block or plug the injection nozzle. Another object of this invention is to provide a means of recirculating unreacted reagent back to the scrubber which does not require any pre-mixing or spraying with a lime slurry solution. Yet another object of this invention is to provide a means of introducing dry solids back to the scrubber without the need to add water or other liquid to re-slurry this recycled product. Still another object of this invention is to improve reagent utilization by recycling ash (unreacted lime, calcium-sulfur salts, fly ash) in such a manner that less equipment is required thereby resulting in fewer moving parts that can jam, become inoperative, or require maintenance. A further object of this invention is to obviate the need for an ash hopper and an ash removal system, expensive equipment which requires additional energy for operation and occupies valuable space. Still another object of this invention is to facilitate re-entrainment of the recycled ash and the slurry particulates as they fall by gravity within the scrubber. These and other objects and advantages will become obvious upon further consideration.

SUMMARY OF THE INVENTION

What is disclosed is a scrubber assembly for removing sulfur from flue gas. This scrubber assembly incorporates a scrubber that has a flue gas inlet, a flue gas outlet, and atomizers therein used for injecting a reagent slurry into the flue gas. Downstream of the flue gas outlet are particulate removal means that remove dry particulate matter from the exiting flue gas. This removed dry particulate matter is then transported or returned back to the scrubber where it is re-injected into the scrubber to decrease the drying time of the sprayed reagent slurry by increasing the surface area overwhich the reagent is sprayed.

BRIEF DESCRIPTION OF THE DRAWING

Sole FIG. 1 is a schematic view of a dry or semi-dry scrubber with the recirculation system contemplated by this invention.

DETAILED DESCRIPTION OF THE INVENTION

Referring to the sole drawing, there is shown a typical dry scrubber 10 configured with flue gas 12 entering inlet 14 and exiting outlet 16. Inside scrubber 10 are atomizers 18 which spray a reagent slurry 20 into incoming flue gas 12. This reagent slurry 20, normally lime based, reacts with flue gas 12 thereby causing any sulfur particles in the flue gas 12 within scrubber 10 to precipitate out. The resulting cleaned (de-sulfured) flue gas 22 then exits scrubber 10 via outlet 16, along with flyash, unspent reagent, and other scrubber by-products, all of which are delivered to downstream cyclone or other separation device 24.

Cyclone or other device 24 separates the incoming cleaned flue gas from the larger, heavier reaction by-products generated in scrubber 10. The bulk of any unspent lime reagent particles delivered to cyclone 24 will, in all likelihood, be very fine in nature and thus will exit cyclone 24 along with cleaned flue gas via stream 22. These unspent lime reagent particles and the cleaned flue gas 22 , i.e. stream 22, will then be delivered to downstream particulate clean-up equipment (not shown) for further separation. The remaining scrubber by-product (or dry solids 26), such as the larger unreacted or unspent reagent, flyash, slaked lime and relatively dry recycle agglomerates, will exit the bottom of cyclone 24 and be delivered to non-mechanical L-valve 28 or some such similar device.

L-valve 28 is operated by injecting fluidizing air 30 (which may be ambient or preheated) into the collected dry solids 26 at a predetermined location. This L-valve 28 is used to transport these dry solids 26 along horizontal conduit 32 and back into scrubber 10. Dry solids 26 would ideally be returned to an approximately central or mid-region of scrubber 10 at a location slightly above atomizers 18 which inject fresh reagent slurry 20 to scrubber 10. As shown, this central or mid-region of scrubber 10 is with respect to its cross-section, not its height. These entering dry solids 26 would then become re-entrained in flue gas 12 and be sprayed with the atomized fresh reagent slurry 20 to further enhance the removal of $SO_2$ from flue gas 12. The resultant by-product would then be discharged from scrubber 10 via outlet 16 and the cycle would repeat itself over again.

Of course, the pressure within conduit 32, prior to re-injection into scrubber 10, would need to be either equal to or greater than the pressure within scrubber 10 at the point of injection.

In the past, one reason for recycling scrubber by-product or dry solids 26 was to return unreacted reagent to the scrubber for further reaction. However, it was found, as stated above, that the bulk of any unspent lime reagent particles delivered to cyclone 24 will, in all likelihood, be very fine in nature and thus will exit cyclone 24 along with cleaned flue gas via stream 22.

In accordance with this invention, a main reason for recycling dry solids 26 is to add such solids to the scrubber to reduce the drying time of reagent slurry 20. This drying time is reduced by adding dry solids 26 to the turbulent gas 12 and fresh reagent 20 flow region. In scrubber 10 with recycle, the absorption reaction occurs in the aqueous phase on the surface of the wetted solid particles, with the resultant product mainly being hydrated calcium sulfite ($CaSO_3.\frac{1}{2}H_2O$), but some gypsum ($CaSO_4.2H_2O$) has also been detected. By adding dry solids 26 to scrubber 10, moisture is distributed over a greater surface area which now includes the surface area of the dry solids 26 (i.e. the larger unspent reagent, flyash, slaked lime, and the relatively dry recycle agglomerates). This will result in a reduction of the drying period and increase the more effective falling rate reaction period for a constant gas residence time.

Thus, this invention is not intended primarily for the recycle of reagent, but for the recycle of dry reaction products and ash which will act as inerts in scrubber 10. Of course, some reagent will be recycled and undergo additional reaction in scrubber 10, but this is not the primary benefit of this invention. The rate controlling step in dry scrubbing is generally believed to be the precipitation of $CaSO_3.01/_2H_2O$. Other reactions proceed much quicker but by recycling $CaSO_3.01/_2H_2O$ and other dry scrubber waste products as seed crystals, less primary nucleation must occur to achieve $SO_2$ removal. Additionally, it should be noted that a significant amount of sulfur dioxide will also be removed by the unspent reagent in the downstream particulate collector (not shown), in cyclone 24, and while the dry solids 26 are being transported by L-valve 28.

It is anticipated that the temperature of dry solids 26 in the recycle stream will generally be no greater than about 200 degrees F. above the adiabatic saturation temperature of flue gas stream 22, depending on the type of reagent used. However, the temperature of the recycle stream is expected to be between 125 degrees F. and 175 degrees F., and in fact, a lower temperature is preferred as long as it does not cause corrosion or plugging in downstream equipment. Thus, it is safe to say that this invention will typically operate in the 100 degree F. to the 500 degree F. temperature range.

While this invention is described with respect to a vertical, up-flow dry scrubber 10 and a non-mechanical L-valve 28, it should be understood that this invention is not limited to solely this type of equipment (it may also be used, for example, on a horizontal dry scrubber or with a different type of material feed device). Additionally, there is no need to limit this invention to the use of a cyclone 24 since this invention is equally capable of being used in conjunction with a baghouse, an electrostatic precipitator, or some other such particulate collection device. Furthermore, this invention may be combined with U.S. Pat. No. 4,891,052 which describes an impingement type solids collector discharge restrictor. This discharge restrictor may be placed at or near outlet 16 of scrubber 10 in addition to the external cyclone 24/L-valve 28 arrangement described above.

It should also be further understood that scrubber 10 is specifically sized for the desired gas velocity to be achieved for dry solids 26 re-entrainment. When this invention is used in an up-flow dry scrubber arrangement, some recycled dry solids 26 and/or larger, wetter fresh reagent slurry 20 droplets may initially fall by gravity within scrubber 10. However, they will soon be re-entrained within flue gas 12 at an elevation just above atomizers 18. This will even further increase the internal residence time of such solids thereby further increasing $SO_2$ removal.

In accordance with this invention then, the recirculation or recycle rate is controlled via operation of L-valve 28 to optimize the sulfur dioxide absorbing reactions. The temperature within scrubber 10 will not be constant due to the spraying of reagent slurry 20 therein, but such fluctuations in temperature in scrubber 10 is considered beneficial to the desulfurization process.

Some of the advantages of this invention include a simplified reactor and recycle system designed to incorporate one or more cyclones or other separation devices 24 for recycling larger, reagent-rich dry ash particles while sending finer particles and clean flue gas stream 22 to downstream particulate removal equipment, such as a baghouse. Another advantage is improved reagent utilization by ash recycle (unreacted lime, calcium-sulfur salts, fly ash), in such a manner as to reduce the need for additional equipment, moving parts, and the necessity of adding water to re-slurry the dry ash. Still another advantage is the re-entrainment of recycled ash and slurry particulates as they fall by gravity in scrubber 10. Yet another advantage is the elimination of the need for an ash hopper and ash removal equipment, expensive machinery that would normally occupy valuable space.

Alternate embodiments of this invention include routing dry solids 26, which have passed through cyclone 24 and which have been fluidized with air, to the air stream of the fresh reagent slurry atomizers 18. Another embodiment involves recycling the ash and partially spent reagent via cyclones 24 and L-valves 28, and then, instead of delivering the dry solids 26 to scrubber 10, add water to these dry solids 26 to re-slurry the reagent for atomization by conventional atomizers and/or nozzles. Yet another embodiment involves configuring L-valve 28 to discharge dry solids 26 to the gas inlet duct at or near flue gas inlet 14. Still another embodiment involves using some other device, instead of cyclones 24, for dry particulate removal from the cleaned flue gas stream. This other device could be, but is not limited to, a vibrating screen or stationary deflectors such as U-beams. Additionally, a baghouse or electrostatic precipitator could be used for dry particulate removal from the cleaned flue gas stream.

I claim:

1. A scrubber assembly for removing sulfur particles from flue gas comprising:

(a) an upflow vertical scrubber tower having a lower flue gas inlet and an upper flue gas outlet, said scrubber tower being constructed and arranged for the passage of a flue gas upwardly therethrough;

(b) atomizer means located separate from and downstream of said lower flue gas inlet for spraying onto said upwardly flowing flue gas, said atomizer means spraying a reagent slurry onto said upwardly flowing flue gas thereby defining a sprayed flue gas, said reagent slurry reacting with said flue gas within said scrubber tower;

(c) particulate removal means located downstream said upper flue gas outlet for removing particulate material from said sprayed flue gas, said particulate removal means separating said sprayed flue gas into a first stream comprising dry solid reaction by-products and a second stream comprising fine unspent solid reagent particles and cleaned flue gas, said dry solid reaction by-products in said first stream comprising primarily flyash, slaked lime, and/or recycle agglomerates said particulate removal means including discharge means for discharge of said first stream;

(d) non-mechanical transport means coupled to said discharge means for returning said first stream to said scrubber tower; and, (e) injection means secured to said scrubber tower for injecting said first stream into a central, mid-region of said scrubber tower at an elevation above said atomizer, said injection means re-entraining said first stream within said flue gas in said scrubber tower to increase the number of nuclei sites available for crystallization within said scrubber tower and also to reduce the drying time of said sprayed reagent.

2. The scrubber assembly as set forth in claim 1 wherein said non-mechanical transport means comprise an L-valve.

3. The scrubber assembly as set forth in claim 2 wherein said scrubber tower is a dry or semi-dry scrubber.

4. The scrubber assembly as set forth in claim 2 wherein said particulate removal means comprise cyclone means for separating said sprayed flue gas into said first and said second streams.

5. The scrubber assembly as set forth in claim 2 wherein said particulate removal means comprise one or more baghouses, electrostatic precipitators, vibrating screens, or stationary deflectors.

6. The scrubber assembly as set forth in claim 2 wherein said L-valve transport means comprise means for directing said first stream onto said reagent slurry sprayed by said atomizer.

* * * * *